US008159512B2

(12) United States Patent
Smits et al.

(10) Patent No.: US 8,159,512 B2
(45) Date of Patent: Apr. 17, 2012

(54) METHOD OF DRIVING A DISPLAY

(75) Inventors: Wilhelmus J. M. Smits, Born (NL); Wilhelmus J. R. Van Lier, San Diego, CA (US); Dolf Ruigt, Sittard (NL); Henricus P. M. Derckx, Weert (NL)

(73) Assignee: Chimei Innolux Corporation, Chu-Nan (TW)

( * ) Notice: Subject to any disclaimer, the term of this patent is extended or adjusted under 35 U.S.C. 154(b) by 681 days.

(21) Appl. No.: 11/921,129

(22) PCT Filed: May 15, 2006

(86) PCT No.: PCT/IB2006/051515

§ 371 (c)(1),
(2), (4) Date: Apr. 6, 2009

(87) PCT Pub. No.: WO2006/126136

PCT Pub. Date: Nov. 30, 2006

(65) Prior Publication Data

US 2009/0195569 A1 Aug. 6, 2009

(30) Foreign Application Priority Data

May 27, 2005 (EP) ..... 05104544

(51) Int. Cl.
*G09G 5/02* (2006.01)

(52) U.S. Cl. ..... 345/694; 345/89; 345/690

(58) Field of Classification Search ..... 345/694, 345/87, 89, 204, 690
See application file for complete search history.

(56) References Cited

U.S. PATENT DOCUMENTS

2001/0038372 A1* 11/2001 Lee ..... 345/89
2002/0097208 A1 7/2002 Hashimoto
2003/0016199 A1* 1/2003 Lee et al. ..... 345/88
2003/0184508 A1* 10/2003 Lee ..... 345/87
2005/0073470 A1 4/2005 Nose et al.

OTHER PUBLICATIONS

PCT International Search Report of Counterpart PCT Application No. PCT/IB2006/051515.

* cited by examiner

*Primary Examiner* — Stephen Sherman
(74) *Attorney, Agent, or Firm* — Liu & Liu

(57) ABSTRACT

The present invention relates to a method of driving a display comprising:

receiving grey level input data, comprising a subpixel input data consisting of N bits, from an external image data source;

mapping the L upper bits of the N-bit subpixel input data to an L-bit first mapped data, where L≦(N−1);

generating an additional bit of mapped data;

using the lower N-L bits of said N-bit subpixel input data for a control operation; including providing a driver data consisting of L+1 bits, based on the first mapped data and the additional bit of mapped data, to a driver circuit; and controlling the driver circuit to output driving voltages set in relation to the driver data, to a display element, wherein the total number of voltage levels correspond to the maximum value representable by the L bits, plus one.

The control operation further comprises, performing frame mixing comprising providing said driver data as either representing said first mapped data or an increment thereof. The additional bit is, inter alia, used to enable representation of said increment.

10 Claims, 6 Drawing Sheets

METHOD OF DRIVING A DISPLAY

FIELD OF THE INVENTION

The present invention relates to a method of driving a display, where the method includes mapping a grey level input data, such as RGB data, of a number of bits, to a smaller number of bits of display driver data, which is fed to the display driver circuits. The grey level data is received from an external image data source, such as a graphic source or a video source.

BACKGROUND OF THE INVENTION

Displays, such as flat panel displays, e.g. liquid crystal displays (LCD), OLED displays, and electroluminescent displays, include a light emitting assembly having two panels provided with two kinds of field generating electrodes, such as pixel electrodes and a common electrode, and an electrically operable layer interposed therebetween. By varying the voltage between the field generating electrodes, the luminance of each pixel is varied. A color display receives N-bit red (R), N-bit green (G), and N-bit blue (B) data from an external graphic source. A signal controller of the display converts the format of the RGB data, and controls a driving unit, which outputs analogue grey voltages corresponding to the RGB data. The grey voltages are applied to the light emitting assembly.

The bit number N of the RGB data input to the signal controller is usually equal to the bit number of data capable of being processed at the driving unit. Currently, available flat panel displays usually process 8-bit data using driving units capable of processing 8-bit RGB data. However the costs thereof are high. There is also a desire to reduce the power consumption. Attempts have been made to design a more cost-effective and low power display by using driver units of a reduced bit number L, such as 6, and mapping the N RGB bits onto the L bits of driver input data. By doing this the image quality is deteriorated. As described in the published US patent application with Pub. No. US 2003/0184508, a method called frame rate control (FRC) has been developed for reconstructing, or virtualizing, as many greys as possible of the $2^N$ originally available greys with only $2^L$ greys available. The FRC has been performed by providing, for each frame, i.e. image data, to be displayed, a plurality of consecutive subframes, or intermediate frames, some pixels thereof having varying greys, such that an average taken over the plurality of subframes simulates, as closely as possible, the frame that would have been generated if all N bits had still been available. This has been done as follows.

The N bits of data are mapped to the L bits of data such that the L upper, or most significant, bits of the N bits are mapped to the L bits while using the remaining M lower, or least significant, bits (LSBs) for generating a sequence of $2^M$ subframes. The M LSBs regulates the number of subframes where the mapped data represents a grey 'A' indicated by the L bits and the number of subframes where the mapped data represents the next higher grey 'A+1'. Additionally, the FRC maps the N-bit data into a predetermined number of L-bit data respectively assigned to pixels in a group of the predetermined number of pixels such that the total number of pixels displaying the grey 'A' and the total number of pixels displaying the grey 'A+1' during a predetermined number of frames are regulated depending on the M LSBs. Due to the averaging effect in the human eye, additional greys between 'A' and 'A+1' can be displayed.

For example, assume that N=8, and L=6. thus, M=2. the 8-bit input data can represent 256 ($2^8$) different greys ranging from '0' to '255'. The upper 6 bits of the input data representing the highest four greys are all equal to '111111' when mapped to the L bits provided to the driver unit. Since there is no 6-bit number larger than '111111' by one, the FRC cannot be applied to these data, and thus the input data representing any of those highest four greys will be represented by a single 6-bit data '111111' for all the subframes. Then, each of red, green and blue colors has only 253 greys.

In accordance with US 2003/0184508 a full number of greys is obtained as follows. The N-bit input data is first up-converted to have a bit number P that is larger than the bit number N of the input data, and then the P bits of the up-converted data are mapped onto a bit number L that is lower than N by mapping the L most significant bits of the P bits onto the L bits and then performing the FRC according to the principle described above. For example, 8 bits are converted to 9 bits. The 6 most significant bits of the 9 bits are used as the 6 bits input to the driver unit. By adding a most significant bit of '0' it is possible to represent all 256 greys. However since the LSBs are now three, i.e. M=3, this is to the prize of generating eight rather than four consecutive subframes. Further, the conversion of 8 bits to 9 bits and the processing of the 9 bits requires additional hardware. Since the ordinary frame rate typically is 60 Hz, in this prior art solution the frame rate is 8-fold, i.e. 480 Hz. The power consumption of an LCD is proportional to the frame rate, and thus the prior art solution providing 256 greys causes a power consumption increase by a factor eight.

SUMMARY OF THE INVENTION

An object of the present invention is to provide a method that is able to provide a good color quality while alleviating the problems of the prior art method described above.

The object is obtained by a method of driving a display according to the present invention as defined in claim 1.

Thus, in accordance with an aspect of the present invention, there is provided a method of driving a display, comprising:

receiving grey level input data from an external image data source, said grey level input data comprising a subpixel input data consisting of N bits;

mapping the N-bit subpixel input data to a first mapped data consisting of L bits, where $L \leqq (N-1)$, wherein the L upper bits of said N-bit input data are used for providing said L-bit first mapped data;

generating an additional bit of mapped data the value of which is dependent on the value of said first mapped data;

using the lower N-L bits of said N-bit subpixel input data for a control operation;

said control operation including providing a driver data consisting of L+1 bits to a driver circuit, wherein said driver data is based on said first mapped data and said additional bit of mapped data, and controlling the driver circuit to output driving voltages to a display element, wherein a voltage level of each driving voltage is set on basis of said driver data, wherein the total number n of voltage levels fulfils the relation $n=2^L+1$; said control operation further comprising, on basis of said lower bits, performing frame mixing comprising providing said driver data as either representing said first mapped data or representing an increment of said first mapped data.

Thus, by performing the mapping operation the number of voltage levels needed is reduced, and thus an amount of circuitry is eliminated, reducing the power consumption, in relation to a conventional display without any mapping. In relation to the prior art method of US 2003/0184508 at least hardware is saved. By adding a single voltage level to the reduced number of voltage levels the mapping operation is still able to simulate the full range of grey levels.

It is to be noted that the expression "frame mixing" is used here instead of frame rate control (FRC), because the frame rate is not necessarily controlled. Rather, primarily, as described above when explaining FRC, it is a question of generating a sequence of mixed frames in order to obtain a desired visual impression, simulating a certain grey level by appropriately mixing a higher and a lower level, since exactly the desired level is not available.

According to an embodiment of the method as defined in claim 2, when all L bits of the first mapped data are ones, they can not represent a straight forward incremented value. Then the additional bit is set high thereby indicating the incremented value, while the mapped bits are kept as are. The resulting driver data causes an output of the maximum voltage level from the driver circuit.

According to an embodiment of the method as defined in claim 3, a slightly different way of realizing the incrementation is presented. In this embodiment the additional bit is used as an ordinary msb (most significant bit) of the driver data, at least when it represents the increment. Then the total number of bits are able to represent a true increment of the first mapped data also when the L bits of the first mapped data are all ones.

According to an embodiment as defined in claim 4, the additional bit is used to control the applying of the highest voltage level independently of the value of the bits of the first mapped data.

These and other aspects and advantages of the invention will be apparent from and elucidated with reference to the embodiments described hereinafter.

BRIEF DESCRIPTION OF THE DRAWINGS

The invention will now be described in more detail and with reference to the appended drawings in which.

DESCRIPTION OF PREFERRED EMBODIMENTS

In a display driving system where the grey level input data originating from an image data source, such as, for example, a graphic processor of a mobile phone or a computer, or a video camera, is reduced into fewer bits, frame mixing is implemented in order to maintain the number of grey levels as far as possible. For example, the grey level input data can be RGB data or YUV data. An embodiment of a display driving system is most schematically shown in FIG. 5. In this particular embodiment the grey level input data consists of RGB input data. Each RGB input data consists of 24 bits. The RGB input data is split into R, G, and B data, consisting of 8 bits each. The final output of the illustrated system is 3×7 bits of driver data, which is to be sent to a driver circuit driving an RGB pixel of the display.

Figure 1:
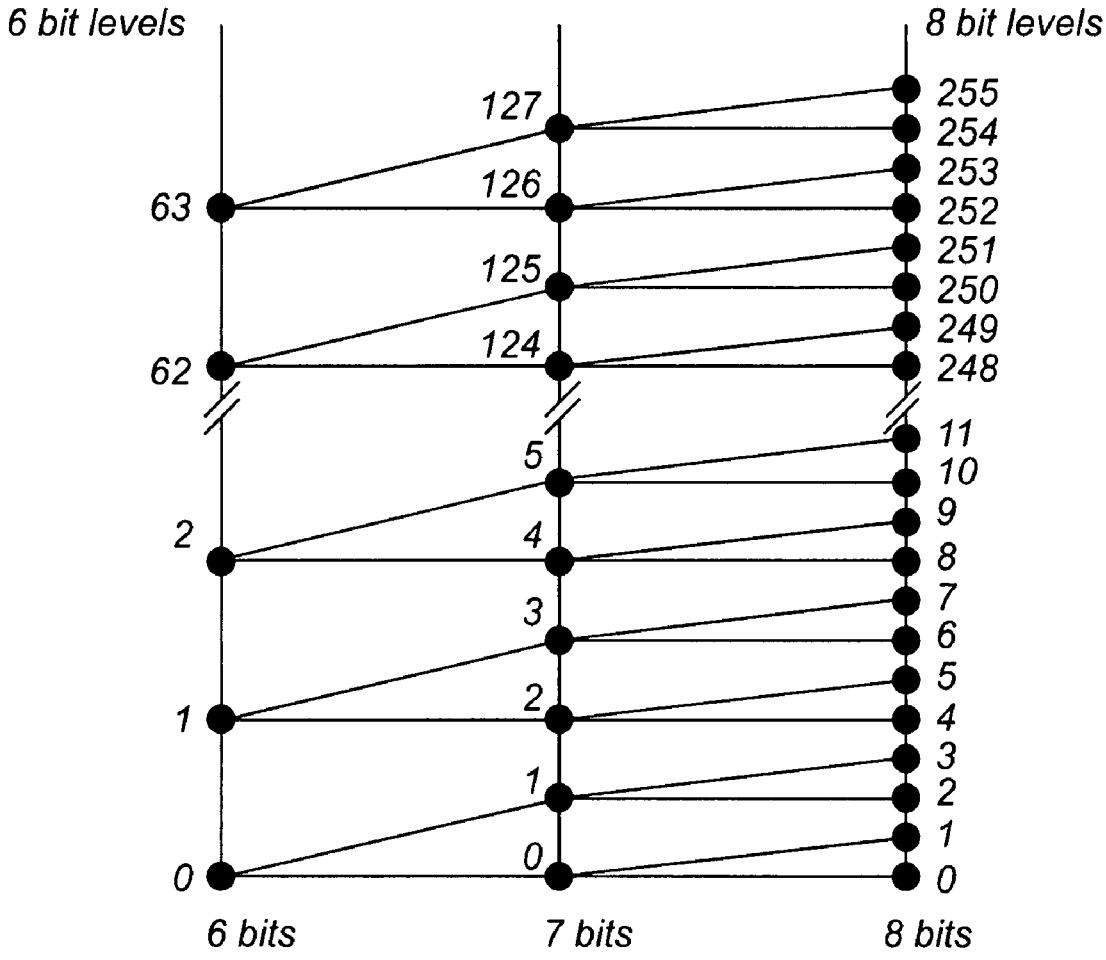
FIG. 1 is a mapping diagram illustrating a basic method.

A first step of preparing the driver data is to map each 8-bit data to a mapped data consisting of 6 bits. The mapping is performed by means of three quantizers 3, 5, 7, one for each 8-bit input data. Since the hardware structure for processing is the same for all three colors, only a single branch, for example the "red branch" will be explained. Basically, a direct mapping, as shown in FIG. 1, is performed by quantization, where the 256 bit levels, i.e. 0 to 255, of the 8-bit input data are mapped such that levels 0-4 are mapped on level 0, levels 4-7 are mapped on level 1, etc. up to levels 252-255, which are mapped on bit level 63 of the 6-bit mapped data. This corresponds to copying the upper 6 bits of the 8-bit data into the 6-bit data and ignoring the two lower bits. For example, '00000101' (=7 binary) becomes '000001' (=1 binary).

Figure 2:
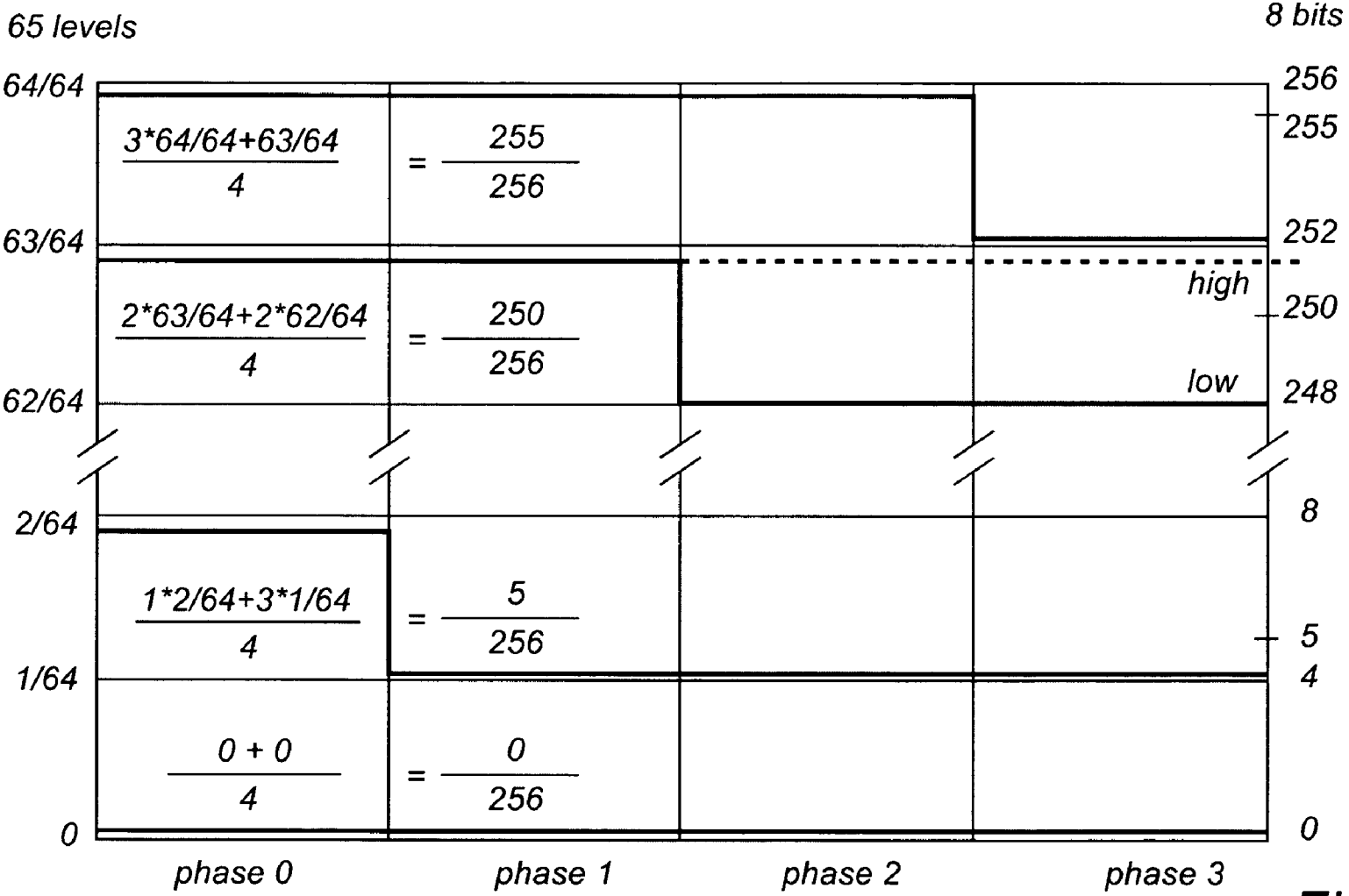
FIG. 2 is a diagram illustrating a temporal frame mixing employed in an embodiment of the method according to the present invention.

However, the lower two bits are also used, but for controlling purposes including the frame mixing. In order to simulate, or virtualize, additional levels which are intermediate of the 64 levels representable with 6 bits, for each frame, i.e. for each input data, a plurality of frames, and thus a plurality of driver data, are output sequentially, i.e. consecutively, where the contents of the frames is varied. Looking at a single pixel, or rather subpixel since each RGB pixel consists of R, G, and B subpixels, each addressable by a driver data, a scheme for temporal frame mixing is shown in FIG. 2. By mixing four frames and alternating between an upper level and a lower level three intermediate levels between the upper and lower level can be obtained. It should be noted that, typically, the different colors, or subpixels, are treated individually having different grey levels. By this temporal frame mixing, for example, level No. 5 of Nos. 0-255 is obtained by providing one frame at level No. 2 of Nos. 0-63 and three frames at level No. 1 of Nos. 0-63, while level No. 6 of Nos. 0-255 is obtained by providing two frames each at levels No. 1 and No. 2 of Nos. 0-63. This mapping method causes a loss of the three highest 8-bit levels, i.e. Nos. 253-255, which cannot be represented with 6 bits.

Figure 3:
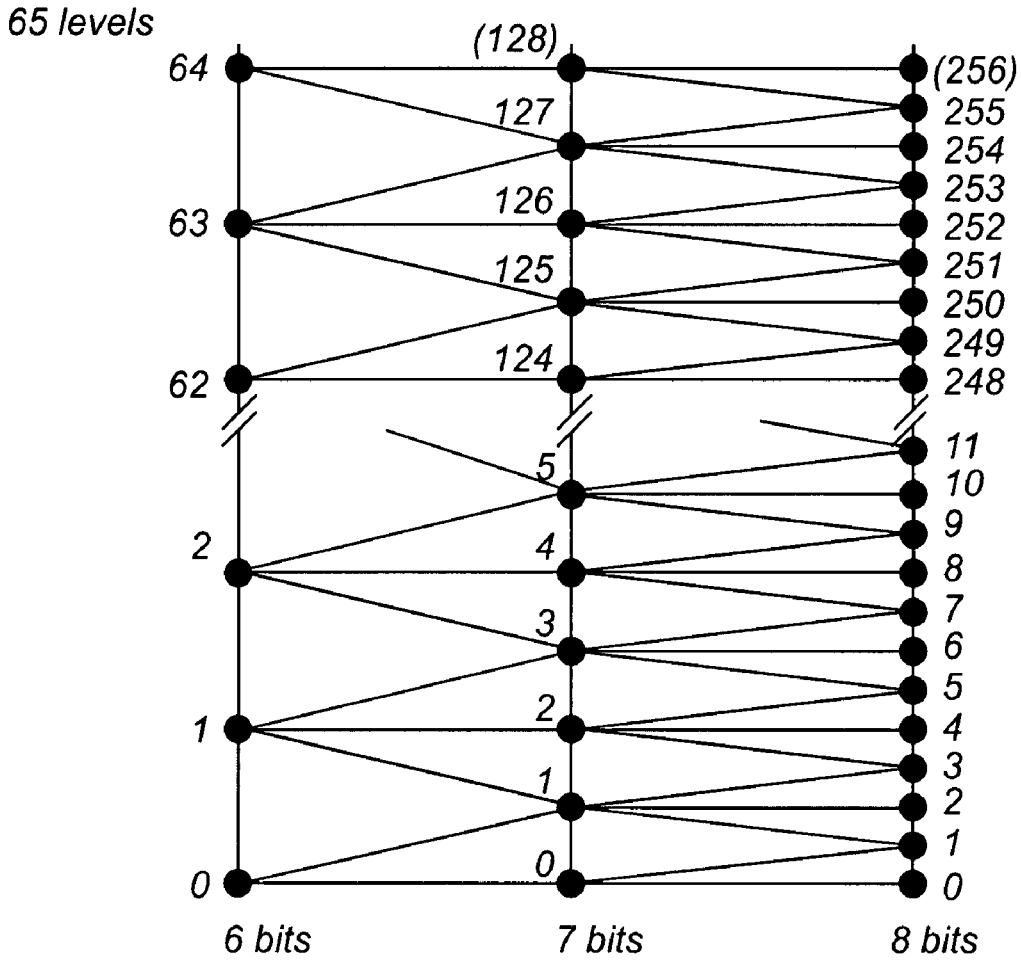
FIG. 3 is a mapping diagram illustrating an embodiment of a the method according to the present invention.
Figure 4:
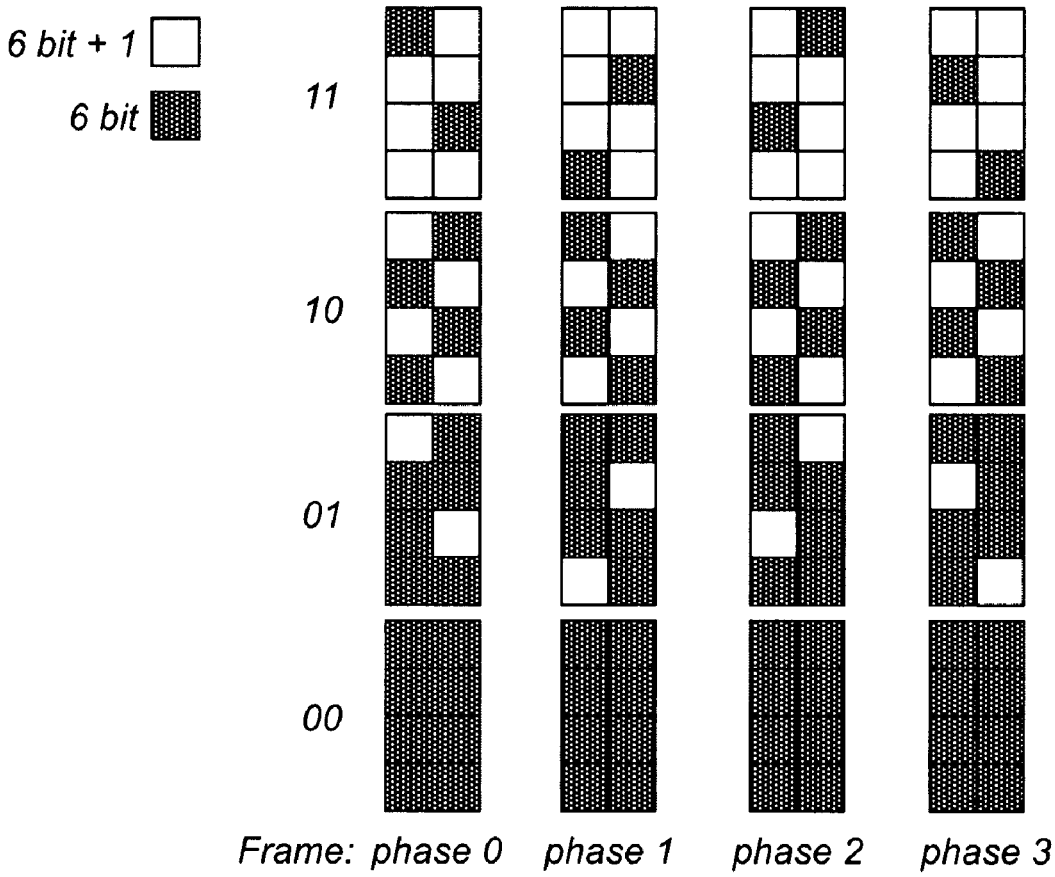
FIG. 4 is a diagram illustrating an example of a combination of spatial and temporal frame mixing.

In accordance with this embodiment of the method according to this invention this problem is solved by providing one more voltage level, i.e. 65 levels in all. Thereby it is possible to reconstruct the 8-bit levels Nos. 253-255 as intermediate levels between levels No. 63 and No. 64. This is shown in FIGS. 3 and 4. Now, for example, level No. 255 is obtained by providing three frames at level No. 64 of Nos. 0-64 and one frame at level No. 63 of Nos. 0-64. Mathematically, the averaging can be expressed as (3*64/64+63/64)/4=255/256.

Figure 5:
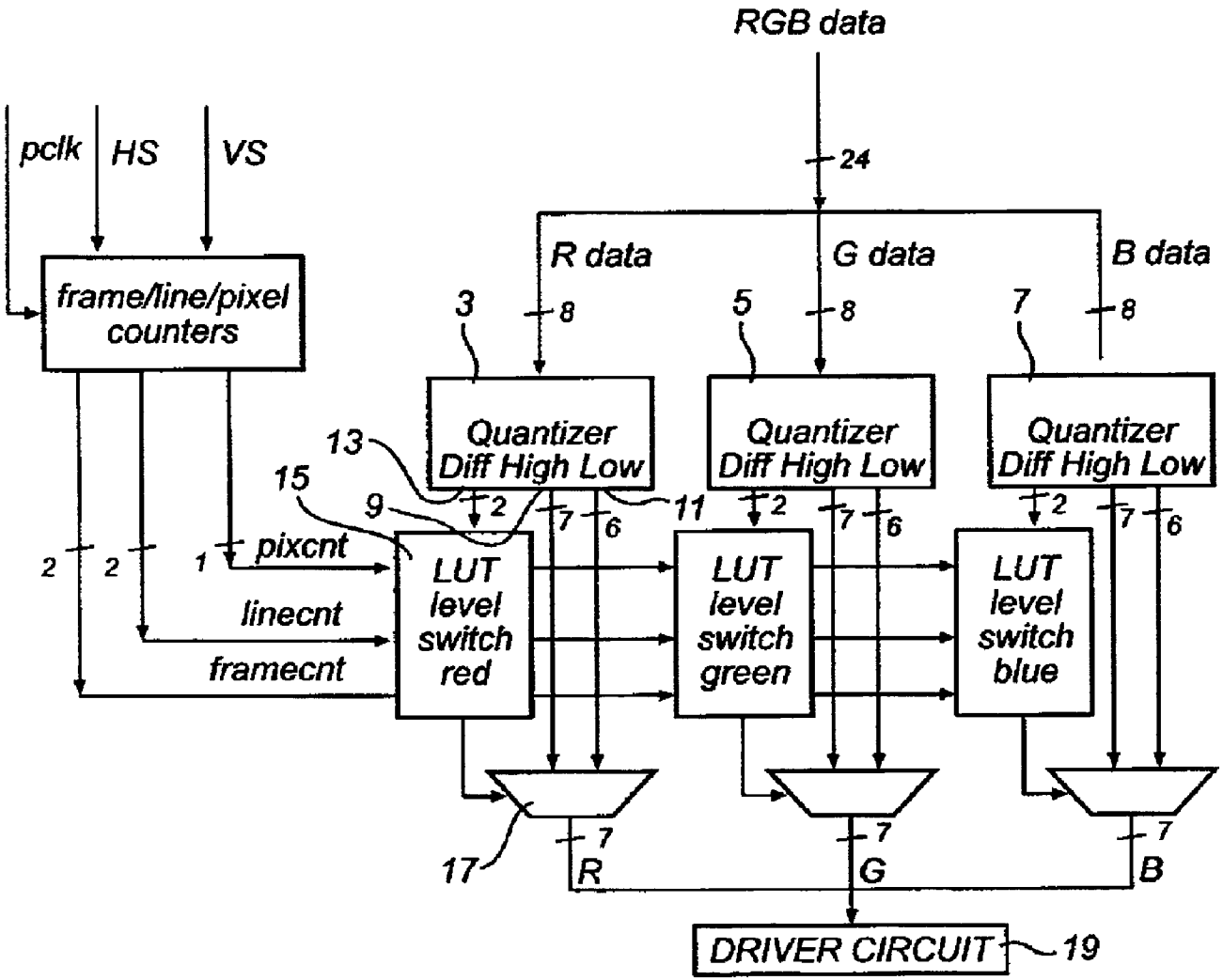
FIG. 5 is a schematic block diagram of mapping and control circuitry for performing an embodiment of the method according to the present invention.

In order to be able to handle the extra voltage level, an additional bit of mapped data is generated. This additional bit is used for instructing the driver circuit that the highest voltage level is to be applied to the subpixel. As shown in FIG. 5 the quantizer 3 has high 9 and low 11 driver data outputs, where the high output 9 consists of 7 bits and the low output 11 consists of 6 bits. These outputs generate the respective upper and lower levels as mentioned above. A third output 13 of the quantizer 3, constituting a control data output, outputs the two lower bits, i.e. the least significant bits, of the 8-bit input data. The control data is fed to a LUT 15 (Look Up Table) level switch, which also receives a 1-bit pixel count, a 2-bit line count, and a 2-bit frame count. On basis of the input data, the LUT level switch controls a MUX (Multiplexer) 17 to pass either the low or the high output of driver data, which is then received at the driver circuit 19.

In this embodiment the high quantizer output is a true increment by one of the low output, which means that the MSB of the high output is '1' only when the low output is '111111', the whole high output thus being '1000000'. Only when choosing this high output the highest voltage level is applied to the red subpixel. Thus, for providing level No. 255 the LUT level switch controls the MUX to pass the high output three times and the low output one time.

In another embodiment the driver data outputs of the quantizer consists of the 6-bit first mapped data and a 1-bit additional data. Consequently, rather than providing a full incremented data comprising the seventh bit, the seventh bit is provided separately. The 6-bit first mapped data is provided as is, and the 1-bit additional data is set to '0' except when the highest voltage level is required. Then it is set to '1'. The additional data overrules the content of the first mapped data, and thus the highest voltage level is applied on the subpixel whenever the additional data contains a '1'.

In addition to the temporal frame mixing a spatial frame mixing is performed, as illustrated in FIG. 4. The possible 4 different values (00, 01, 10, and 11) that the two LSBs of the control output can take, a group of a plurality of pixels show different patterns of grey levels, and for every value except for 00 the pattern varies throughout the sequence of four frames. For example, in FIG. 4, the pixels are divided into groups of 4×2=8 pixels. Each group consists of an upper and a lower 2×2 pixel matrix. In the figure, a white pixel corresponds to the high output and a shaded pixel corresponds to the low output. Each one of the four frames is called a phase. For example, when the LSBs are '01', in phase 0, which is the first phase, the upper left pixel of the upper matrix, and the upper right pixel of the lower matrix correspond to the high output, while all other pixels correspond to the low output. In phase 1, the lower right pixel of the upper matrix and the lower left pixel of the lower matrix correspond to the high output, while the rest of the pixels correspond to the low output, etc. With this combined spatial and temporal frame mixing the image quality percepted by the human eye is further increased in relation to using only temporal frame mixing. It is to be noted, though that both temporal and spatial frame mixing can be performed in many different ways. Further examples can be seen in the above-mentioned US 2003/0184508.

Figure 6:
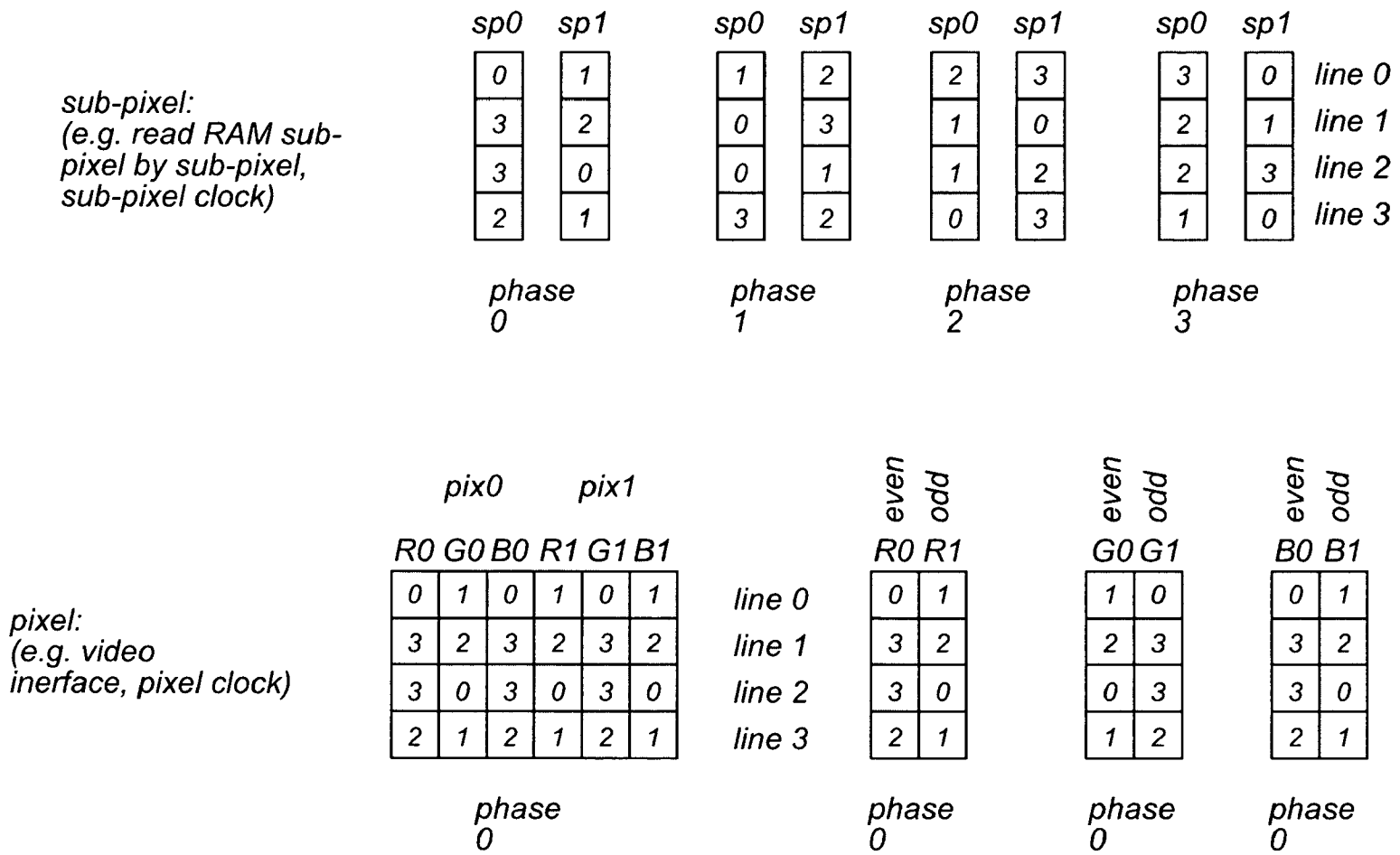
FIG. 6 is a diagram illustrating an example of subpixel combinations in different phases.

In FIG. 6 temporal and spatial mixing is illustrated on a subpixel level. In this example, 8 to 6 mapping is employed. There are four consecutive frames forming the impression of an image based on graphic input RGB data, which in a conventional system without quantizing (mapping) would generate a single frame. The four frames are called phases 0-3. Different voltage levels can be applied to a subpixel in different phases. In order to obtain good color quality, the phases of neighboring subpixels are mixed. In this example the RGB display has color stripes, where R, G, and B subpixels are neighbors. The subpixel phases can be mixed as exemplified in FIG. 6.

Above, embodiments of the method according to the present invention have been described. These should be seen as merely non-limiting examples. As understood by those skilled in the art, many modifications and alternative embodiments are possible within the scope of the invention.

For example, the mapping can be performed from 8 to 7 bits, wherein the driver data output consists of 8 bits. This is equal to the number of bits of input data. However, looking at the voltage levels that have to be generated the saving is half of the number used in the conventional 8 bit case plus one for the additional voltage level. Thus a substantial savings in hard ware as well as power consumption is obtained also in this case.

It is to be noted, that for the purposes of this application, and in particular with regard to the appended claims, the word "comprising" does not exclude other elements or steps, that the word "a" or "an", does not exclude a plurality, which per se will be apparent to those skilled in the art.

Thus, in accordance with the present invention, there is provided a method of driving a display, wherein grey level input data are mapped to a smaller number of bits. The mapped data is used for controlling driver circuitry. The number of voltage levels generated by the driver circuitry correspond to the highest value representable by the mapped data plus one. Therefore an additional bit is added to the mapped data as an msb. By means of temporal frame mixing the intermediate voltage levels lost due to the mapping are "simulated" by appropriately combining a higher and a lower voltage level in consecutive frames. Due to the additional voltage level also the highest voltage levels are reconstructable.

The invention claimed is:

1. A method of driving a display, comprising:

receiving grey level input data from an external image data source, said grey level input data comprising a subpixel input data consisting of N bits;

mapping the N-bit subpixel input data to a first mapped data consisting of L bits, where $L \leqq (N-1)$, wherein the L upper bits of said N-bit subpixel input data are used for providing said L-bit first mapped data;

generating an additional bit of mapped data the value of which is dependent on the value of said first mapped data, wherein the additional bit of mapped data has only one bit, the additional bit of mapped data is high when all bits of said first mapped data are high, and the additional bit of mapped data is low when all bits of said first mapped data are not high;

using the lower N-L bits of said N-bit input data for a control operation; said control operation including providing a driver data consisting of L+1 bits to a driver circuit, wherein said driver data is based on said first mapped data and said additional bit of mapped data, and controlling the driver circuit to output driving voltages to a display element, wherein a voltage level of each driving voltage is set on basis of said driver data, wherein the total number n of voltage levels fulfils the relation $n=2^L+1$; said control operation further comprising, on basis of said lower bits, performing frame mixing comprising providing said driver data as either representing said first mapped data or representing an increment of said first mapped data.

2. A method according to claim 1, wherein if all bits of said first mapped data are high, said increment consists of said first mapped data and said additional bit of mapped data set high.

3. A method according to claim 2, wherein said increment consists of said first mapped data and said additional bit of mapped data as a most significant bit of increment, and said increment is a true increment by one of said first mapped data.

4. A method according to claim 2, wherein said voltage level is set to the highest voltage level if said additional bit of mapped data is a '1'.

5. A method according to claim 2, wherein N=8 and L=6.

6. A method according to claim 2, wherein said frame mixing comprises temporal and spatial frame mixing and combinations thereof.

7. A method according to claim 1, wherein said increment consists of said first mapped data and said additional bit of mapped data as a most significant bit of increment, and said increment is a true increment by one of said first mapped data.

8. A method according to claim 1, wherein said voltage level is set to the highest voltage level if said additional bit of mapped data is a '1'.

9. A method according to claim 1, wherein N=8 and L=6.

10. A method according to claim 1, wherein said frame mixing comprises temporal and spatial frame mixing and combinations thereof.

* * * * *